United States Patent [19]

Atkinson

[11] 4,438,637

[45] Mar. 27, 1984

[54] COOLING CONTAINER FOR CANNED BEVERAGES AND SANDWICHES

[76] Inventor: Lyle H. Atkinson, 3828 Pavant Dr., Salt Lake City, Utah 84120

[21] Appl. No.: 409,545

[22] Filed: Aug. 19, 1982

[51] Int. Cl.[3] ..... F25D 3/08

[52] U.S. Cl. ..... 62/457; 62/371

[58] Field of Search ..... 62/371, 372, 430, 457, 62/529, 530

[56] References Cited

U.S. PATENT DOCUMENTS

| | | | |
|---|---|---|---|
| 4,213,310 | 7/1980 | Buss | 62/457 |
| 4,249,392 | 2/1981 | Hotta | 62/457 |
| 4,295,345 | 10/1981 | Atkinson | 62/457 X |
| 4,351,165 | 9/1982 | Gottsegen et al. | 62/457 X |

FOREIGN PATENT DOCUMENTS

| | | | |
|---|---|---|---|
| 2025593 | 1/1980 | United Kingdom | 62/457 |

*Primary Examiner*—Lloyd L. King

*Attorney, Agent, or Firm*—K. S. Cornaby

[57] ABSTRACT a reusable concave container for carrying and cooling canned beverages and sandwiches having a bottom section containing a plurality of cylindrical compartments communicating with each other by open channels for accomodating canned beverages or sandwiches, a top section containing either corresponding compartments or a separable water storage pack, quick-release securing snaps for securing the top section to the bottom section, and a shoulder strap for carrying the container.

8 Claims, 7 Drawing Figures

COOLING CONTAINER FOR CANNED BEVERAGES AND SANDWICHES

This Application is related to my issued U.S. Pat. No. 4,295,345.

BACKGROUND OF THE INVENTION

It is often desirable to take cold drinks, sandwiches and the like, along when hiking, fishing, traveling or attending sports events. The present invention provides a lightweight, reusable container for carrying and cooling canned beverages, sandwiches and other light foods.

Prior art cooling containers employ slow warming cooling gels or other means of cooling, and come in a variety of designs and configurations, but none has contemplated use of the principle that heat rises and cold drops to retain more effectively canned beverages or other foods in a cold state. Moreover, none has recognized that the handling of bulky packages of freezing gels, such as "Blue Ice", can be an undesirable problem in refrigerator freezing compartments. In prior art devices, in order to prepare the cooling means for use it is necessary to place that part of the unit which contains the cooling means in a freezer.

The present invention incorporates the cooling means in its lid which is not much larger than an ice cube tray. This is a significant improvement over the coolers which have the cooling means located in a relatively large bottom portion of the container. Such an arrangement requires that a substantial amount of space be made available in the user's freezer compartment in order to prepare the cooling means for use.

Other prior art coolers are constructed so as to provide accommodations for either canned beverages or sandwiches and the like, but not both. Other prior art coolers contemplate use of only the slow-freezing gels, such as "Blue Ice", as the cooling medium for the cooling containers, and are not equipped to permit the use of water for both cooling purposes and for drinking.

It is an objective of the present invention to provide a cooling container for delivering cold air to the lower areas of the cooling container and to insulate canned beverages and sandwiches or the like in order to keep them cold for longer periods of time.

It is also an objective of this invention to provide a removable water container in the lid of the cooling container for both cooling and drinking purposes.

SUMMARY OF THE INVENTION

According to the present invention a cooling container is provided with a housing having a preferably concave shape, such that it can rest comfortably on the user's hip when carried from the shoulder by means of the provided carrying strap or with a clip for attachment to the user's belt. It is contemplated that the housing be constructed of a suitable, lightweight insulating material, thus providing a durable, low cost product to the consumer.

Broadly stated, the cooling container comprises a top section or lid, a bottom section or receptacle, and a carrying means. In one embodiment, the top section contains a plurality of recessed cavities corresponding to beverage can tops interconnected by cut-away portions between the cavities to accomodate sandwiches. Each cavity may contain a freezing gel, such as "Blue Ice", or water to be used as the cooling medium. In a second embodiment, the lid has a single cavity and a water pack adapted to be secured in the cavity. The water pack has a spout for filling and use so that the pack can be used both for cooling the container and for drinking water.

Incorporated into the bottom section are circular compartments corresponding to the typical beverage can with the compartments interconnected by in-line openings to accomodate sandwiches or similar items of food. A carrying means, such as a shoulder strap or belt clip, or both, is secured to the bottom section.

Another embodiment of the invention has a removable center block in the bottom section encompassing one of the circular compartments. Removal of the block permits the resulting chamber to be utilized as a receptacle for larger sandwiches, packets of vegetables, etc., to be kept cool. The upper section, or lid, may or may not have a corresponding removeable block therein.

The top section of the cooling container is detachable from the bottom section by suitable detachable means, so that it may be prepared for use by placement in a freezer for a time sufficient to freeze the water. In use, the beverages or sandwiches to be kept cold are inserted into the compartments of the bottom section, the top section is placed on top of the receptacle—the cooling means having been previously readied for use—and means for securing the lid to the receptacle are fastened. The cold from the frozen water can then descend from the top section within each compartment, and can surround each beverage can or sandwich with cold to retain the beverage in each can or each sandwich in a cold state for a lengthy period of time.

Further objects and features of the invention will become apparent from the following detailed description, taken together with the accompanying drawings.

BRIEF DESCRIPTION OF THE DRAWINGS

Preferred embodiments for carrying out the inventions are illustrated in the accompanying drawings, in which.

DETAILED DESCRIPTION OF THE PREFERRED EMBODIMENTS

Figure 1:
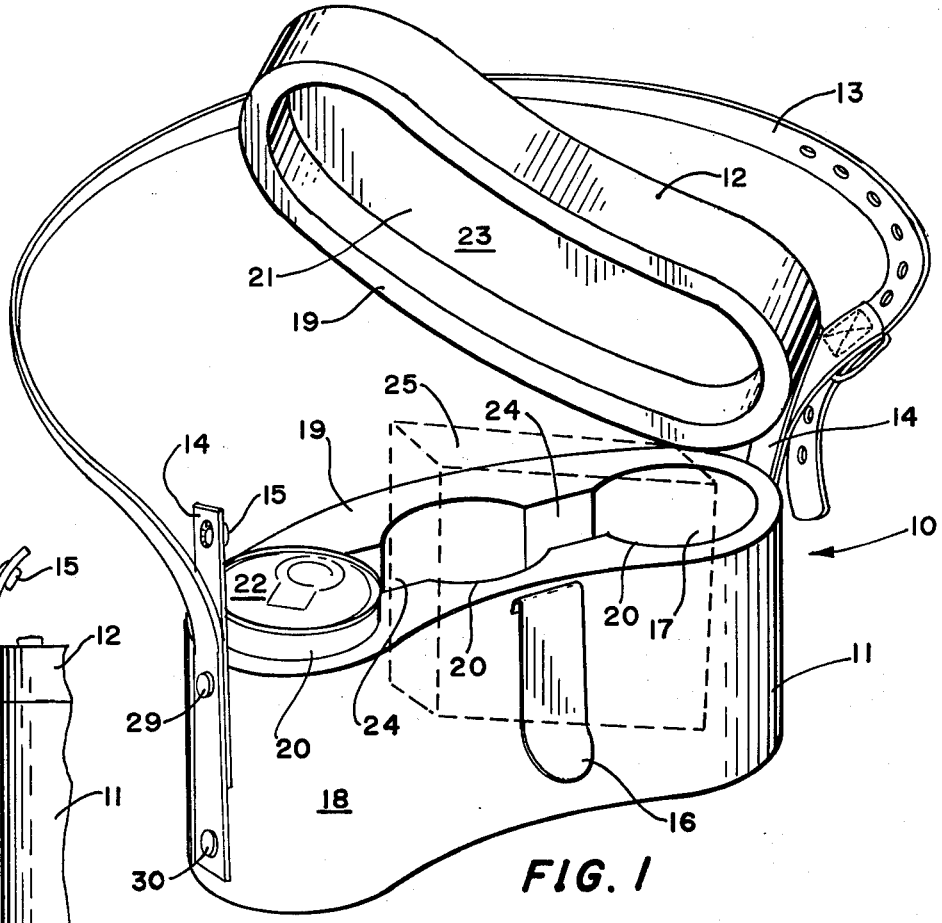
FIG. 1 is an elevational perspective view of the cooling container showing the upper section partially removed and a wrapped sandwich in dashedline perspective.

As illustrated in FIG. 1, a cooling container 10 in accordance with the invention has a bottom section or receptacle 11, a top section or lid 12, and a shoulder strap 13 as a means of carrying the invention. Preferably the receptacle 11 and lid 12 are formed of a suitable lightweight insulating material, for example, high-impact polystyrene, polythylene or polypropylene, whereas the carrying strap 13 may be fashioned from any suitable plastic or leather material. Strap means for securing lid 12 to receptacle 11 as shown here in FIGS. 1 and 5 as a strap 14 having a snap closure 15. As an alternative to carrying strap 13, a belt clip 16 is provided on the side of receptacle 11 for securing the container 10 to the belt of a user.

Figure 2:
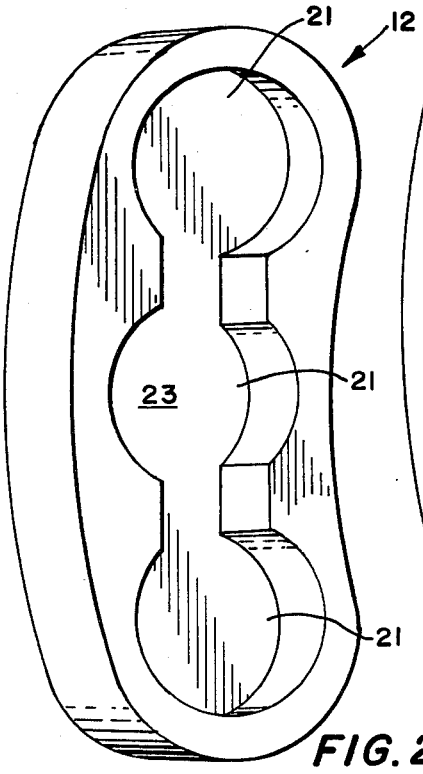
FIG. 2, an elevational perspective view of one embodiment of the container lid, showing cavities connected by open sections.

As shown in FIGS. 1 and 2 an inner shell 17 and an outer shell 18 of container 10 and closure 12 form a cavity which is filled with an insulating material 19, such as polyurethane foam, and form vertically extending receiving compartments 20 in receptacle 11 and recessed cavities 21 in the closure 12. The receiving compartments 20 are adapted to receive cans of beverages 22 to be cooled, the depth of compartments 20 being such that the upper portion of the can of beverage 22 extends slightly above the upper surface of receptacle 11, thereby facilitating easy removal of the canned beverage. Within the recessed cavities 21 of closure 12 are located cooling means 23 which is prepared for use by placing the detachable closure 12 in the freezer compartment of a refrigerator. A preferred coolant can be water or a slow-thawing cooling gel, known as "Blue Ice".

The recessed cavities 21 are interconnected by passages 24 which provide space for holding sandwiches, shown in FIG. 1 in outline form as 25. Such an arrangement permits the carrying of both canned beverages and sandwiches in one container 10.

In use, closure 12 is placed over receptacle 11 in a manner such that the recessed cavities 21 of the closure 12 encase the exposed portion of the cans of beverages 22 located in the receiving compartments 20 of receptacle 11. Cooling means 23, having previously been frozen, imparts cooling within the individual compartments 17 of sealed container 10 by cooling air adjacent to it which in turn descends to the lower portions of the compartments until equilibrium is achieved and the cans of beverages and/or sandwiches thus are surrounded by a body of cold air.

Figure 3:
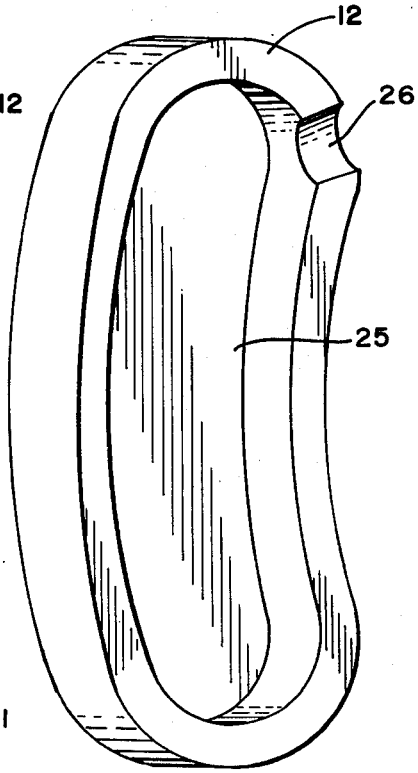
FIG. 3, a perspective view of a second embodiment of the container lid, showing a single open cavity for receipt of a water-containing sack.
Figure 4:
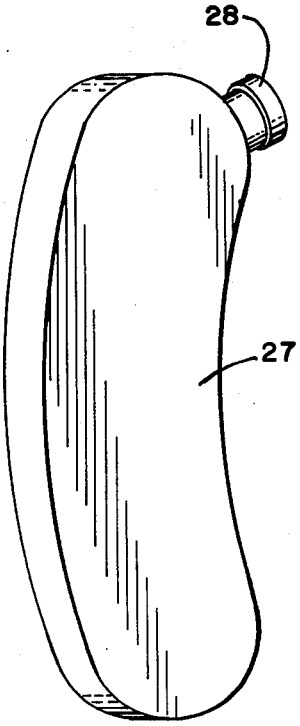
FIG. 4, a perspective view of the water-containing pack for disposition in the lid of FIG. 3.

An alternative embodiment for closure 12 is shown in FIGS. 3 and 4. Closure 12 is provided with a single cavity 25 and a semi-circular aperture 26 extending from cavity 25 to the exterior of insulation 19. A hollow pouch 27 shown in FIG. 4 is formed in the same shape as cavity 25 and may be constructed of a flexible material, such as plastic. Pouch 27 is adapted to carry drinking water and can be frozen in a freezer prior to use, then placed into cavity 25 and used as a coolant until it melts. At that point, the cold water can be drunk through a closable spout 28, which is adapted to be extended through aperture 26 in closure 12.

Figure 5:
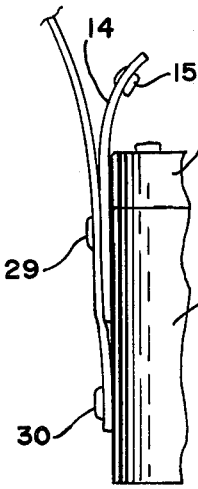
FIG. 5, a fragmentary side elevational section corresponding to a portion of FIG. 1, showing the snap-closure strap for securing the lid to the receptacle.

As shown in FIG. 5, the fastening means for the closure 12 and container 11 is illustrated in detail. When container 10 is to be used with belt clip 16, carrying strap 13 can be detached from receptacle 11 by disconnecting fasteners 29, 30 on both sides of the receptacle.

Figure 6:
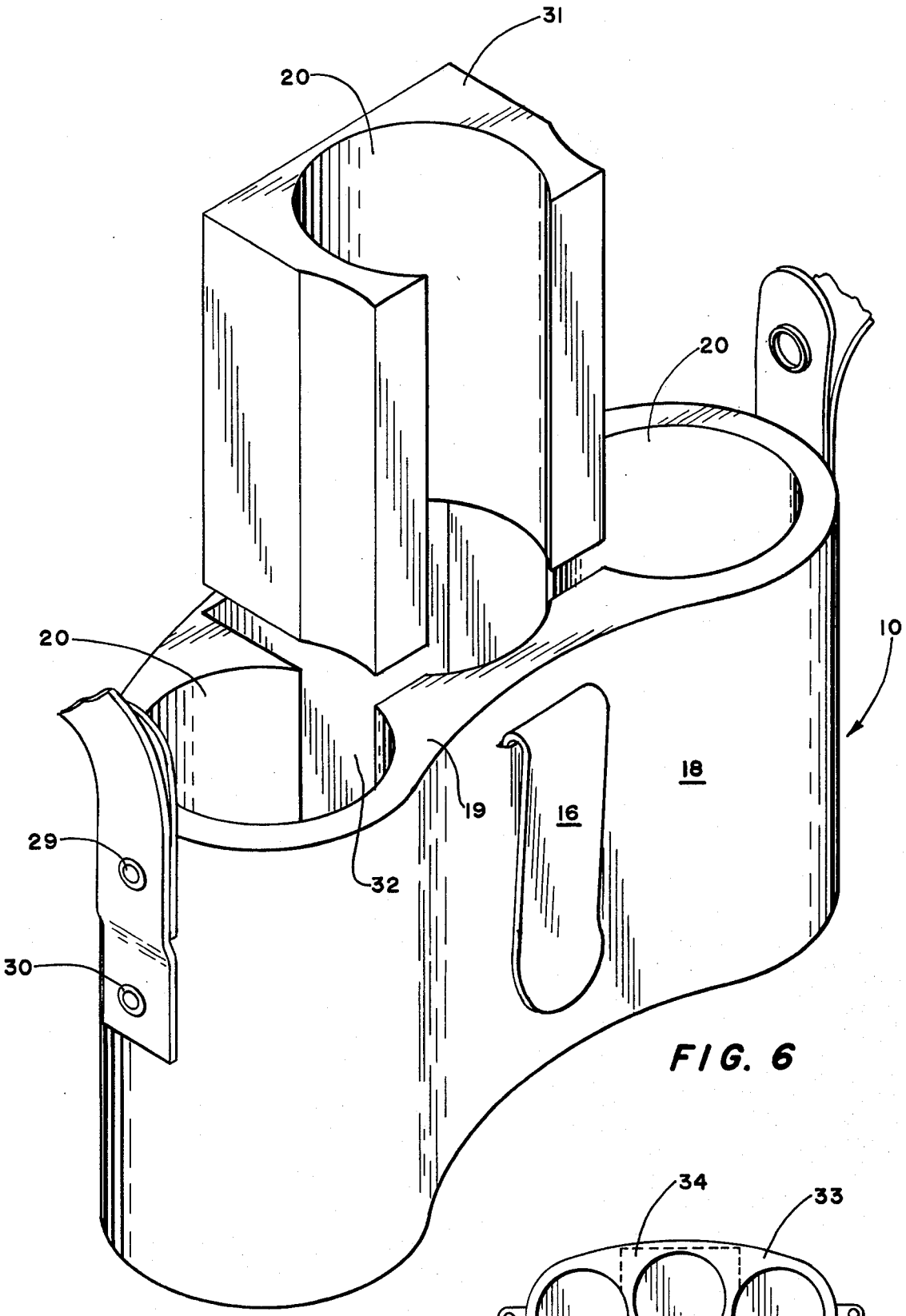
FIG. 6, an elevational perspective view of an alternative embodiment of the container showing the rectangular removeable block above the receptacle.
Figure 7:
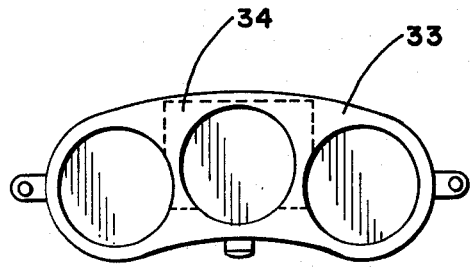
FIG. 7, a top plan view of the upper section of the embodiment illustrated in FIG. 6, showing a block in outline form.

Another embodiment of the invention is illustrated in FIGS. 6 and 7, in which the container 10 has a preferably rectangularly-shaped block 31, which is removeably disposed in container 10. The removal of block 31 leaves a rectangularly-shaped receptacle 32 in container 10 to accomodate larger or multiple sandwiches, small packages of vegetables, fruit, or the like, which can be kept cool along with the cans of beverages in circular receptacle 20. The same downward flow of cold air is maintained from the upper section using any of the previous designs described herein or the configuration shown in FIG. 7.

In FIG. 7, the upper lid 33 can be used as shown in FIGS. 2, 3 and 4, or can incorporate the removal of a corresponding block 34 from lid 33, shown in dotted-line in FIG. 7.

Although preferred embodiments of the invention have been herein disclosed, it is to be understood that the present disclosure is made by way of example and that variations are possible without departing from the scope of protection defined in the attached claims.

I claim:

1. A portable cooling container for transporting and cooling canned beverages, comprising in combination:

a curved bottom housing having a plurality of vertically oriented conical compartments for holding canned beverages, said housing having walls of insulating material which surround said compartments;

a removeable center block in said bottom housing for providing a receptacle for sandwiches surrounded by insulating material;

a correspondingly curved top housing having walls of insulating material and having a plurality of recessed cavities therein correspondingly to said vertically oriented compartments in said bottom housing;

a coolant disposed in the upper ends of each respective recessed cavity of said top housing;

flexible means attaching said bottom housing to said top housing; and means for carrying said top and bottom housings.

2. A container as set forth in claim 1, wherein said top housing has a single recessed cavity encompassing the area of the compartments in said bottom housing and containing a coolant.

3. A container as set forth in claim 2, wherein said top housing has a single recessed cavity and has a separate coolant pouch with a closable spout for removeable disposition in said single cavity.

4. A container as set forth in claim 3, wherein said coolant comprises drinking water.

5. A container as set forth in claim 1, wherein said coolant comprises drinking water.

6. A container as set forth in claim 1, wherein said carrying means comprises a carrying strap with means for attaching to said bottom housing.

7. A container as set forth in claim 1, wherein said carrying means comprises a belt hook attached to said bottom housing.

8. A container as set forth in claim 1, wherein said curved top housing has a removeable center block therein.

* * * * *